US012037559B2

(12) United States Patent
Packet

(10) Patent No.: US 12,037,559 B2
(45) Date of Patent: Jul. 16, 2024

(54) LOW POUR POINT DERIVATIVES OF DIMER FATTY ACIDS

(71) Applicant: OLEON NV, Evergem (BE)

(72) Inventor: Dirk Packet, Rotselaar (BE)

(73) Assignee: OLEON NV, Evergem (BE)

( * ) Notice: Subject to any disclaimer, the term of this patent is extended or adjusted under 35 U.S.C. 154(b) by 0 days.

(21) Appl. No.: 17/597,641

(22) PCT Filed: Jul. 16, 2020

(86) PCT No.: PCT/EP2020/070170
§ 371 (c)(1),
(2) Date: Jan. 14, 2022

(87) PCT Pub. No.: WO2021/009295
PCT Pub. Date: Jan. 21, 2021

(65) Prior Publication Data

US 2022/0267694 A1 Aug. 25, 2022

(30) Foreign Application Priority Data

Jul. 16, 2019 (EP) ..... 19186633

(51) Int. Cl.

| | |
|---|---|
| ***C10M 105/36*** | (2006.01) |
| ***C10M 105/04*** | (2006.01) |
| ***C10M 105/14*** | (2006.01) |
| ***C10M 105/68*** | (2006.01) |
| ***C10N 20/02*** | (2006.01) |
| ***C10N 40/04*** | (2006.01) |
| ***C10N 40/08*** | (2006.01) |
| ***C10N 40/22*** | (2006.01) |
| ***C10N 40/25*** | (2006.01) |
| ***C10N 40/30*** | (2006.01) |

(52) U.S. Cl.
CPC ..... *C10M 105/36* (2013.01); *C10M 105/04* (2013.01); *C10M 105/14* (2013.01); *C10M 105/68* (2013.01); *C10M 2203/0206* (2013.01); *C10M 2207/0215* (2013.01); *C10M 2207/0225* (2013.01); *C10M 2207/2825* (2013.01); *C10M 2215/0806* (2013.01); *C10N 2020/02* (2013.01); *C10N 2040/04* (2013.01); *C10N 2040/08* (2013.01); *C10N 2040/22* (2013.01); *C10N 2040/25* (2013.01); *C10N 2040/30* (2013.01)

(58) Field of Classification Search
CPC ..... C10M 105/04; C10M 105/14; C10M 105/36; C10M 105/68; C10M 2203/0206; C10M 2203/0215; C10M 2203/0225; C10M 2203/2825; C10M 2215/0806; C10N 2020/02; C10N 2040/04; C10N 2040/08; C10N 2040/22; C10N 2040/25; C10N 2040/30
See application file for complete search history.

(56) References Cited

U.S. PATENT DOCUMENTS

| | | | | |
|---|---|---|---|---|
| 2,955,121 | A | 10/1960 | Meyer et al. | |
| 5,503,762 | A | 4/1996 | Bongardt et al. | |
| 6,160,144 | A | 12/2000 | Bongardt et al. | |
| 9,944,878 | B2 * | 4/2018 | Butke | C10M 133/56 |
| 2016/0097014 | A1 * | 4/2016 | Jeon | C10M 177/00 508/496 |
| 2017/0073609 | A1 | 3/2017 | Chen et al. | |

FOREIGN PATENT DOCUMENTS

CN 107236591 A * 10/2017

OTHER PUBLICATIONS

Nakano et al., "Thermal alteration of oleic acid in the presence of clay catalysts with co-catalysts", vol. 62, No. 5, 1985, p. 888-891, Journal Of The American Oil Chemists' Society (JAOCS), Springer, DE.
International Search Report and Written Opinion for PCT/EP2020/070170, mailed Oct. 14, 2020.
Den Otter M.J.A.M.: "2.7 Dimerisation of oleic acid with clay catalysts", Jan. 1, 1968, pp. 24-26.

* cited by examiner

*Primary Examiner* — James C Goloboy
(74) *Attorney, Agent, or Firm* — ARENTFOX SCHIFF LLP

(57) ABSTRACT

The present invention relates to specific derivatives of dimer fatty acids, compositions comprising them and a method to reduce pour points.

10 Claims, No Drawings

LOW POUR POINT DERIVATIVES OF DIMER FATTY ACIDS

CROSS-REFERENCE TO RELATED APPLICATIONS

This application is a 35 U.S.C. 371 National Phase of PCT Application No. PCT/EP2020/070170, filed on Jul. 16, 2020, which claims priority to EP Application No. 19186633.4, filed on Jul. 16, 2019, the disclosures of each of which are hereby incorporated by references in their entireties.

The present invention relates to derivatives of dimer fatty acids, and more particularly to low pour point derivatives of dimer fatty acids, their uses as base oil and lubricant compositions comprising them, such as engine oils, hydraulic fluids, drilling fluids, gear oils and compressor oils.

Dimer fatty acids result from the dimerization of unsaturated fatty acid(s). Dimer fatty acids are usually a mixture of dimer fatty acids being structural isomers (linear and cyclic isomers).

Commercially available dimer fatty acids are usually made out of fatty acids feedstock rich in unsaturated fatty acids, such as fatty acids feedstocks obtained from rapeseed, canola, soybean, rice bran, and tall oil, or unsaturated fatty acid fractions obtained from animal fats or palm oil or palm kernel oil.

Therefore, commercially available derivatives of dimer fatty acids are thus obtained from such commercial dimer fatty acids.

By "derivatives of dimer fatty acids", it is more specifically intended esters, amides, alcohols and alkanes obtained from dimer fatty acids.

Those derivatives of dimer fatty acids are particularly useful in lubricant compositions, due to their good properties, such as good cold stability properties.

However, their pour points are not low enough for uses in cold regions.

The Applicant surprisingly found that specific derivatives of dimer fatty acids present lower pour points.

Accordingly, the present invention relates to derivatives of dimer fatty acids obtainable by the process comprising the following steps:

i) dimerization of fatty acid(s) feedstock, whose oleic acid content is more than 80 wt % based on weight of fatty acid(s) contained in the feedstock, by heating in the presence of a clay catalyst;

ii) separation of the monomer fatty acids from the dimer fatty acids formed during step i);

iii) derivatization of dimer fatty acids to produce dimer fatty esters, amides, alcohols or alkanes.

The derivatives of dimer fatty acids thus obtained, can be made from renewable feedstock(s).

Indeed, fatty acid(s) feedstocks are advantageously fatty acids obtained from a renewable oil. A renewable oil is preferably a vegetable oil or an animal oil, such as described above. Corresponding fatty acids may be recovered from a vegetable oil or an animal oil, by any known method in the art.

Preferably, the fatty acid(s) feedstock is a vegetable oil with a naturally high oleic content oil, or an enriched oleic acid fraction of a vegetable oil.

Indeed, fatty acids obtained from any renewable oil may be fractionated to isolate one or more specific unsaturated fatty acid(s) and to obtain an adapted feedstock.

Alternatively, some renewable oils that are mono and polyethylenically unsaturated, but comprise less than 80% by weight of oleic acid based on the weight of the fatty acids contained in the renewable oil, may be partially hydrogenated to optimize their oleic content, prior to the recovering of corresponding fatty acids. Suitable renewable oils to partially hydrogenate are rapeseed oil, corn oil, soya bean oil, sunflower oil, safflower oil and tall oil.

Advantageously, the fatty acid(s) feedstock is fatty acids obtained from high oleic sunflower oil. Indeed, this vegetable oil naturally contains a high content of oleic acid.

The fatty acid(s) feedstock comprises preferably at least 95 wt %, more preferably at least 97 wt % of fatty acid(s), weight percentages being based on weight of the feedstock.

The derivatives of dimer fatty acids present similar or lower viscosities than known derivatives of dimer fatty acids. Derivatives of dimer fatty acids of the invention are stable at high temperatures and resist UV radiations.

Advantageously, the derivatives of dimer fatty acids of the present invention exhibit better cold flow properties. In particular, pour points of the present derivatives of dimer fatty acids are lower than the pour points of corresponding commercial derivatives of dimer fatty acids, wherein dimer fatty acids are obtained from other feedstocks, as shown in Example 3. Pour points are lowered by at least 10%, preferably by at least 15%.

The pour point refers to the lowest temperature at which a liquid remains pourable. Thus, in cold regions, derivatives of dimer fatty acids of the invention are advantageous since they can be more easily used.

The pour point can be determined according to method described in ASTM D97.

Step i) is performed at a sufficient temperature to achieve a dimerization reaction.

The dimerization step is preferably conducted at a temperature ranging from 200° C. to 250° C.

In the present application, unless otherwise indicated, all ranges of values used are to be understood as being inclusive limits.

Preferably, the dimerization reaction is conducted under inert atmosphere, such as under nitrogen stream.

The reaction can be conducted at a pressure ranging from 1 barg to 10 barg, preferably from 2 barg to 8 barg.

By "barg", it is intended the unit of the gauge pressure measurement.

In particular, the reaction can be conducted at a pressure ranging from $2.10^5$ Pa to $11.10^5$ Pa, preferably, from $3.10^5$ Pa to $9.10^5$ Pa.

The dimerization step may be conducted during 1 hour to 8 hours, preferably during 2 hours to 5 hours.

The clay catalyst is preferably selected among bentonite, montmorillonite, beidellite, nontronite, saponite, hormite (attapulgite, sepiolite) or mixtures thereof.

Advantageously, the clay catalyst is bentonite.

The clay catalyst content preferably ranges from 1 to 10%, preferably from 2 to 8% by weight, based on the total weight of the feedstock.

The dimerization step may be performed in the presence of water, the water content ranging preferably from 0.1 to 5% by weight based on the total weight of the feedstock.

Advantageously, the dimerization step may be conducted in the presence of up to 0.5% by weight of an alkali metal salt, weight % being given on the total weight of the feedstock.

The dimerization conditions allow obtaining dimer fatty acids at a yield ranging from 40% to 60%, preferably from 40 to 50%.

The dimerizing step may be followed by an additional step of treatment with an inorganic acid, preferably with phosphoric acid.

The dimerizing step may be followed by an additional step of separation of the clay catalyst from the reaction product of step i), preferably by filtration.

Step ii) is preferably achieved by distillation, in particular by thin film distillation, at a temperature ranging from 200 to 300° C. and at a pressure ranging from 1 to 4 mbar.

"Derivatization of dimer fatty acids", i.e. step iii), preferably refers to an esterification, an amidification, a reduction or a decarboxylation reaction of both carboxylic functions of dimer fatty acids.

Those reactions can be conducted by any method known by the person skilled in the art.

Thus, derivatives of dimer fatty acids are preferably esters of dimers fatty acids (also called "dimer fatty esters"), amides of dimer fatty acids (also called "dimer fatty amides"), alcohols of dimer fatty acids (also called "dimer fatty alcohols") or dimer fatty alkanes.

Dimer fatty esters are obtainable by the process described above, wherein the derivatization step is an esterification of dimer fatty acids with an alcohol.

The alcohol is preferably a linear or branched monohydroxyl hydrocarbon chain, having 1-13 carbon atoms. In particular, the alcohol is saturated.

In particular, dimer fatty esters are of formula $R^2O$—OC—$R^1$—CO—$OR^2$ wherein, $R^1$ is a hydrocarbon chain comprising 34 carbon atoms, and $R^2$ comprises between 1 and 13 carbon atoms.

Preferably, $R^2$ is a linear or branched hydrocarbon chain, in particular saturated.

Dimer fatty amides are obtainable by the process described above, wherein the derivatization step is an amidification of dimer fatty acids with an amine.

The amine is preferably a compound comprising a single primary amine or secondary amine function. In particular, the amine is of formula $R^2$—$NH_2$ or $R^2$—($R^3$)NH, wherein $R^2$, $R^3$, identical or different, are each a linear or branched hydrocarbon chain, having 1-13 carbon atoms. More particularly, the amine is saturated.

In particular, dimer fatty amides are hydrocarbon chain of the formula $R^2$—NH—OC—$R^1$—CO—NH—$R^2$ or $R^2$-($R^3$)N—OC—$R^1$—CO—N($R^3$)-$R^2$, wherein, $R^1$ is a hydrocarbon chain comprising 34 carbon atoms, and $R^2$, $R^3$, identical or different, comprise between 1 and 13 carbon atoms.

Preferably, $R^2$ and $R^3$ are each a linear or branched hydrocarbon chain, in particular saturated.

Dimer fatty alcohols are obtainable by the process described above, wherein the derivatization step is a reduction of the carboxylic functions of dimer fatty acids.

In particular, dimer fatty alcohols are of formula HO—CH2-$R^1$—CH2—OH wherein, $R^1$ is a hydrocarbon chain comprising 34 carbon atoms.

Dimer fatty alkanes are obtainable by the process described above, wherein the derivatization step is a decarboxylation of dimer fatty acids.

In particular, the dimer fatty alkanes comprise 34 carbon atoms.

After step iii), derivatives of dimer fatty acids are obtained with low pour points, in particular lower than −55° C.

The invention also concerns the use of the derivatives of dimer fatty acids of the invention as a base oil.

Base oils can be categorized into five groups:

group I oils: these oils have a saturated hydrocarbon content less than 90% by weight, an aromatic hydrocarbon content higher than 1.7% by weight, a sulfur content higher than 0.03% by weight, weight percentages being based on the weight of the oil, and a viscosity index between 80 and 120;

group II oils: these oils have a saturated hydrocarbon content higher than 90% by weight, an aromatic hydrocarbon content less than 1.7% by weight, a sulfur content less than 0.03% by weight, weight percentages being based on the weight of the oil, and a viscosity index between 80 and 120;

group III oils: these oils have a saturated hydrocarbon content higher than 90% by weight, an aromatic hydrocarbon content less than 1.7% by weight, a sulfur content less than 0.03% by weight, weight percentages being based on the weight of the oil, and a viscosity index higher than 120;

group IV oils: oils made of polyalphaolefins (PAO);

group V oils: all synthetic oils that are not described in the previous categories:

synthetic oils are obtained by chemical reaction between molecules of petrochemical origin and/or of renewable origin, with the exception of the usual chemical reactions used to obtain mineral oils (such as hydrorefining, hydrocracking, hydrotreating, hydroisomerization, etc.). Examples of synthetic oils, are esters, naphtenic oils, polyalkylene glycols (PAG).

More particularly, dimer fatty esters, dimer fatty amides and dimer fatty alcohols of the invention can be used as a base oil of group V.

Dimer fatty alkanes of the invention can be used as a base oil of group III.

The invention also concerns the use of the derivatives of dimer fatty acids of the invention to reduce the pour point of a composition. Preferably, the use of the derivatives of dimer fatty acids of the invention in a composition allows a reduction of the pour point of at least 10%, compared to the same composition not comprising these derivatives of dimer fatty acids.

The invention also relates a composition comprising derivatives of dimer fatty acids of the invention and an additive used in the field of lubricants.

A person skilled in the art knows how to select the most suitable additive(s) depending on the lubricating application. By way of example, reference may be made to the following manuals: "Fuels and Lubricants Handbook: technology, properties performance and testing", by George E. Totten, 2003 and "Handbook of lubrification and tribology, vol II: Theory and Design", by Robert W. Bruce, 2012.

More particularly, the composition of the invention, comprises:

derivatives of dimer fatty acids of the invention; and an additive chosen from the group constituted by antioxydants, anti-foaming agents, de-emulsifiers, anti-corrosion (or anti-rust) agents, thickening agents, detergents, metal deactivators, dispersants and mixtures thereof.

The antioxidant is preferably selected from the group constituted by saturated organic monosulphides; organic polysulphides, such as dialkyl disulphides, dialkyl trisulphides; sulphurized olefins (SO); dithiocarbamic acid derivatives, such as dithiocarbamates; sulphurized phenols, such as sulphurized alkylphenols (SAP); (alkyl or aryl-) phosphites, such as tributyl phosphite and triaryl-phosphites; dithiophosphoric acid derivatives, such as dithiophosphates and dialkyldithiophophates, for example zinc dialkyldithiophosphates (ZDTP); hindered substituted phenols, such as 2,6-di-t-butyl-4-methylphenol (BHT), 4,4'-methylenebis(2,6-di-tert-butylphenol) (MBDTBP) or dibutylparacresol (DBPC), le 3,5-di-tert-butyl-4-hydroxyhydrocinnamate (ABHHC) optionally alkylated, 4,4'-thiobis(2-methyl-6-tert-butylphenol) and 2,6-di-tert-butylphenol (DTBP); sulphurized hindered phenols (SHP); arylamines or aromatic amines, such as mono and dialkyl diphenylamines (DPA) like dioctyldiphenylamine, optionally alkylated N-phenyl-1-naphthylamines (PANA), phenothiazines and alkylated derivatives thereof, tetramethyldiaminophenylmethane and N,N'-disecbutyl-p-phenylenediamine.

The anti-foaming agent is preferably selected from the group constituted by silicone oils, silicone polymers, and alkyl acrylates.

The de-emulsifier is preferably a propylene oxide copolymer.

The anti-corrosion (or anti-rust) agent is preferably selected from the group constituted by alkali and/or alkaline-earth metal sulphonates (Na, Mg, Ca salts), fatty acids, fatty amines, alkenylsuccinic acids and/or derivatives thereof, and benzotriazole.

The thickening agent is preferably a fatty ester.

The detergent is preferably chosen from the group constituted by calcium and/or magnesium salts of alkylaryl sulphonates, alkylphenates, alkylsalicylates and/or derivatives thereof.

The metal deactivator is preferably chosen from the group constituted by heterocyclic compounds containing nitrogen and/or sulphur, for example triazole, tolutriazole and benzotriazole.

The dispersant is preferably chosen from the group constituted by alkenylsuccinimides, succinic esters and/or derivatives thereof, and Mannich bases.

The composition of the invention may further comprise another base oil, in particular a base oil from group III oils or group V oils.

The invention relates the use of the composition of the invention as a lubricant composition.

Preferably, the lubricant composition is an engine oil, an hydraulic fluid, a drilling fluid, a gear oil or a compressor oil.

The invention also relates to a method to reduce the pour point of derivatives of dimer fatty acids by producing dimer fatty acids from fatty acid(s) feedstock, whose oleic acid content is more than 80 wt % based on weight of fatty acid(s) contained in the feedstock, in the presence of a clay catalyst.

More specifically, the invention relates to a method to reduce the pour point of derivatives of dimer fatty acids by esterifying, amidifying, reducing or decarboxylating the carboxylic functions of dimer fatty acids obtained by the process comprising the following steps:

i) dimerization of fatty acid(s) feedstock, whose oleic acid content is more than 80 wt % based on weight of fatty acid(s) contained in the feedstock, by heating in the presence of a clay catalyst;

ii) separation of the monomer fatty acids from the dimer fatty acids formed during step i).

By "method to reduce the pour point of derivatives of dimer fatty acids", it is meant that the pour point of derivatives of dimer fatty acids obtained by esterifying, amidifying, reducing or decarboxylating the carboxylic functions of dimer fatty acids obtained according to the above process is lower than the pour point of derivatives of dimer fatty acids obtained by the same derivatization (esterification, amidification, reduction or decarboxylation reaction) of the carboxylic functions of dimer fatty acids obtained according to another process.

Advantageously, derivatives of dimer fatty acids of the invention have a pour point lower than −45° C., preferably lower than −55° C., more preferably lower than −60° C.

The invention also concerns a method to reduce the pour point of a composition by adding derivatives of dimer fatty acids produced in the presence of a clay catalyst from fatty acid(s) feedstock, whose oleic acid content is more than 80 wt % based on weight of fatty acid(s) contained in the feedstock.

By "method to reduce the pour point of a composition", it is meant that the pour point of a composition obtained by adding derivatives of dimer fatty acids according to the invention is lower than the pour point of the same composition lacking these derivatives of dimer fatty acids.

In this method according to the invention, the quantity of derivatives of dimer fatty acids in the composition is preferably of at least 50 wt % based on the weight of the composition. In particular, the composition is a lubricant composition.

The methods of the invention allow a reduction of the pour point of at least 10%.

In these methods, derivatives of dimer fatty acids, fatty acid(s) feedstock and clay catalyst are such as defined above.

The invention is further described in the following examples. It will be appreciated that the invention as claimed is not intended to be limited in any way by these examples.

EXAMPLE 1

Process For Preparing Dimer Fatty Acids 1.1 Preparation of dimer fatty acids from fatty acids obtained from high oleic sunflower oil Dimerization 1800 g of fatty acids obtained from high oleic sunflower oil (comprising 83.7 wt % of C18:1, 7.3 wt % of C18:2, 3.7 wt of C16:0 and 3 wt % of C18:0) and 90 g of natural bentonite clay catalyst were placed together in an autoclave. Air was flushed out of the autoclave with nitrogen. While stirring, the mixture was heated to 230° C. This reaction temperature was held for 3 hours, the pressure had built up to 4 barg ($5.10^5$ Pa).

The reaction mixture was then cooled down to 80° C., while removing gaseous components by venting with nitrogen. After adding 27 g of 75 wt % phosphoric acid, temperature was raised again to 130° C. and pressure was lowered to 60 mbar. These conditions were held for one hour until all water was removed from the product.

The clay catalyst was subsequently removed from the reaction product by vacuum filtration.

Recovering of the Dimer Fatty Acids

The dimer fatty acids, amounting to substantially 44 wt %, were separated from the monomer fatty acids by distillation up to 260° C. under 2 mbar.

1.2 Preparation of Comparative Dimer Fatty Acids from Rapeseed Fatty Acids

Those comparative dimer fatty acids were prepared as described above using fatty acids obtained from rapeseed oil (comprising 61.7 wt % of C18:1, 18.4 wt % of C18:2, 10.1 wt % of C18:3, 4.5 wt of C16:0 and 1.5 wt % of C18:0) instead of fatty acids obtained from high oleic sunflower oil.

EXAMPLE 2

Process For Preparing Esters of Dimer Fatty Acids 2.1 Preparation of 2-ethylhexyl ester of dimer fatty acids according to the invention 796 g of dimer fatty acids prepared in Example 1.1 and 554 g of 2-ethylhexanol are loaded in a 2 liter glass reactor equipped with a Dean Stark set up, which allows efficient recycling of distilled and condensed 2-ethylhexanol and removal of the reaction water. The molar ratio 2-ethylhexanol to dimer acid equals 3.1.

The reactor is heated to 210° C. and atmospheric pressure under continuous recycling of the distilled 2-ethylhexanol and removal of the reaction water through the Dean Stark set up. When an acid value of 9 mg KOH/g is reached, the Dean Stark set up is removed and the reaction is continued until the acid value is lower than 3 mg KOH/g. At this moment the reactor is gradually put under vacuum until a pressure of 5 mbar is reached, and the remaining excess of 2-ethylhexanol is distilled at 210° C. Acid values are measured according to standard ISO 660:2009.

2.2 Preparation of comparative 2-ethylhexyl ester of dimer fatty acids

This comparative dimer fatty esters were prepared as described above using comparative dimer fatty acids prepared in Example 1.2.

2.3 Preparation of methyl ester of dimer fatty acids according to the invention

The methyl ester was prepared according to method described in Example 2.1 using methanol instead of 2-ethylhexanol.

EXAMPLE 3

Pour Points of Dimer Fatty Acids and Esters Thereof

Pour points were determined according to method described in ASTM D97. Results obtained are gathered in Table 2 below:

TABLE 2

Pour points of dimer acids and esters thereof according to the invention and of comparative dimer fatty acids and esters thereof

| | Pour point (° C.) |
|---|---|
| Dimer fatty acids | −11 |
| Comparative dimer fatty acids | −12 |
| 2-ethylhexyl ester of dimer fatty acids of the invention | −63 |
| Comparative 2-ethylhexyl ester of dimer fatty acids | −54 |
| Methyl ester of dimer fatty acids of the invention | −48 |

As can be seen, esters of dimer acids of the invention have a lower pour point. The pour point of 2-ethylhexyl ester of dimer fatty acids is lowered by 16% when prepared from fatty acids obtained from high oleic sunflower oil instead of rapeseed oil.

Methyl ester of dimer fatty acids of the invention has a lower pour point that the pour point (−43° C.) of the methyl ester of dimer fatty acids obtained from a high oleic acid content as fatty acids feedstock, using zeolite as catalyst as described in patent application U.S. 2016/0097014 A1.

For applications such as in lubricant field, the lower the pour point the better. This makes the derivatives of dimer fatty acids disclosed in this invention particularly useful as base oil for lubricant compositions used in cold regions, for automotive or industrial applications.

EXAMPLE 4

Kinematic Viscosities of Dimer Fatty Esters

Kinematic viscosities were determined according to method described in ASTM

D445. Results obtained are gathered in Table 3 below.

TABLE 3

Kinematic viscosities of dimer fatty esters

| | Kinematic viscosity at 40° C. ($m^2/s$) | Kinematic viscosity at 100° C. ($m^2/s$) |
|---|---|---|
| 2-ethylhexyl ester of dimer fatty acids of the invention | 89.4 | 12.9 |
| Comparative 2-ethylhexyl ester of dimer fatty acids | 94 | 14.0 |

Kinematic viscosity at 40° C. and 100° C. of 2-ethylhexyl ester of dimer fatty acids prepared from fatty acids obtained from high oleic sunflower oil, are slightly lower than kinematic viscosity 2-ethylhexyl ester of dimer fatty acids prepared from fatty acids obtained from rapeseed oil.

The invention claimed is:

1. Derivatives of dimer fatty acids obtainable by the process comprising the following steps:

i) dimerizing a fatty acid mixture feedstock, whose oleic acid content is more than 80 wt % based on weight of fatty acid mixture contained in the feedstock, by heating in the presence of a clay catalyst;

ii) separating monomer fatty acids from the dimer fatty acids formed during step i); and iii) derivatizing dimer fatty acids to produce dimer fatty esters, amides, alcohols or alkanes; wherein the derivatization step is an esterification, an amidification, a reduction or a decarboxylation reaction of the carboxylic functions of dimer fatty acids, wherein the fatty acid mixture feedstock are fatty acids from high oleic sunflower oil.

2. The derivatives of dimer fatty acids of claim 1, wherein the temperature of dimerization is between 200 and 250° C.

3. The derivatives of dimer fatty acids of claim 1, wherein the clay catalyst is bentonite.

4. A base oil comprising the derivatives of dimer fatty acids of claim 1.

5. A composition comprising:

derivatives of dimer fatty acids of claim 1; and an additive used in the field of lubricants.

6. A lubricant composition comprising the composition of claim 5.

7. The composition of claim 6, wherein the lubricant composition is an engine oil, a hydraulic fluid, a drilling fluid, a gear oil or a compressor oil.

8. A method to reduce the pour point of derivatives of dimer fatty acids by carrying out an esterification, an amidification, a reduction or a decarboxylation reaction of the carboxylic functions of dimer fatty acids obtained by the process comprising the following steps:

i) dimerizing fatty acid mixture feedstock, whose oleic acid content is more than 80 wt % based on weight of fatty acid mixture contained in the feedstock, by heating in the presence of a clay catalyst; and ii) separating the monomer fatty acids from the dimer fatty acids formed during step i), wherein the fatty acid mixture feedstock are fatty acids from high oleic sunflower oil.

9. A method to reduce the pour point of a composition comprising adding derivatives of dimer fatty acids produced in the presence of a clay catalyst from dimer fatty acids from fatty acid mixture feedstock, whose oleic acid content is more than 80 wt % based on weight of fatty acid mixture contained in the feedstock, and wherein the fatty acid mixture feedstock are fatty acids from high oleic sunflower oil.

10. The method of claim 9, wherein the quantity of derivatives of dimer fatty acids, added to the composition, is of at least 50 wt % based on the weight of the composition.

* * * * *